US005795199A

United States Patent [19]

Langenberg et al.

[11] Patent Number: 5,795,199

[45] Date of Patent: Aug. 18, 1998

[54] PROPELLER DRIVE FOR WATERCRAFT

[75] Inventors: Hans Langenberg, Hamburg; Hansjorg Klante, Wedel, both of Germany

[73] Assignee: Blohm + Voss Holding AG, Hamburg, Germany

[21] Appl. No.: 892,483

[22] Filed: Jul. 14, 1997

Related U.S. Application Data

[63] Continuation of Ser. No. 635,714, Apr. 22, 1996, abandoned.

[30] Foreign Application Priority Data

Apr. 22, 1995 [DE] Germany ..... 195 14 878.9

[51] Int. Cl.[6] ..... B63H 5/07

[52] U.S. Cl. ..... 440/79; 114/166

[58] Field of Search ..... 440/50, 51, 53, 440/79, 80; 114/144 R, 151, 166

[56] References Cited

U.S. PATENT DOCUMENTS 1,800,135 4/1931 Corcoran ..... 440/51
3,056,374 10/1962 Linhardt ..... 440/67
5,205,764 4/1993 Thiger ..... 440/79

FOREIGN PATENT DOCUMENTS 211994 12/1983 Japan ..... 440/79
893489 4/1962 United Kingdom ..... 114/166

OTHER PUBLICATIONS

"First Cargo Vessel with an 'Active' Rudder", The British Motor Ship; pp. 238–239, Sep. 1962.

*Primary Examiner*—Jesus D. Sotelo
*Attorney, Agent, or Firm*—Nils H. Ljungman and Associates

[57] ABSTRACT

A propeller drive for watercraft, preferably for ferry boats and car ferries, which has two propellers located one behind the other in the center-line plane. The forward propeller is preferably located on a marine shaft which exits the hull, and can be driven by means of a drive system. The aft propeller is preferably driven by means of a separate drive system, and the aft propeller is realized so that it can pivot by at least about 90 degrees around an axis, the axis being preferably vertical.

19 Claims, 3 Drawing Sheets

PROPELLER DRIVE FOR WATERCRAFT

This application is a continuation of U.S. patent application Ser. No. 08/635,714, filed on Apr. 22, 1996, now abandoned, which claims priority from Fed. Rep. of Germany Patent Application No. 195 14 878.9-22, filed on Apr. 22, 1995.

BACKGROUND OF THE INVENTION

1. Field of the Invention

This invention generally relates to a propeller drive for watercraft, preferably for ferry boats and car ferries, which have two propellers located one behind the other in the center-line plane of the vessel.

2. Background Information

On certain types of vessels, e.g. on ferry boats and car ferries, the following problems exist. In open water, they must achieve the highest possible speed. In and around the harbor, their speed must be low and their maneuverability must be high, even in a high wind. It should be possible for the vessel to land and cast off without the assistance of tows. Finally, the vessel must remain maneuverable even in the event of the failure of essential propulsion elements, and the vessel must still be able to reach port without outside assistance.

Previously, the majority of such vessels were constructed as dual-screw vessels, whereby each of the propellers located laterally had its own drive engine. Lateral thrust propellers were available for use during landing and casting off.

Disadvantages of such known vessels include:

1. With these propulsion systems, the reduction of speed to the lowest possible value is limited, and the speed can only be reduced to extremely low levels when variable pitch propellers are used.

2. Sufficient maneuvering capability requires two rudders which, if possible, are realized in the form of fin rudders and have particularly good angles of attack.

Generally, the vessel lands and casts off using thrust propellers. Such known vessels are not highly maneuverable in the presence of strong winds and currents, which means that in those cases assistance from tows is essential.

OBJECT OF THE INVENTION

The object of the invention is therefore to eliminate these disadvantages, i.e. to create a propulsion system which makes very good maneuverability possible even when the vessel is traveling at slow speeds.

SUMMARY OF THE INVENTION

The present invention teaches that this object can be accomplished by the forward propeller being preferably located on a marine shaft which extends out of the hull. The forward propeller can be propelled by a drive system located in the hull via the marine shaft. The aft propeller can be driven by means of a separate propulsion system, and the aft propeller can be realized so that it can pivot by at least about 90 degrees around a preferably vertical shaft. Additional configurations of the invention are realizable.

As a result of the propeller system claimed by the invention, the disadvantages described above can be essentially eliminated as follows:

As a result of the presence of the aft propeller, there is a reduction in the load on the forward main propeller, which reduces its problems with cavitation and simultaneously improves its efficiency.

When suitable propulsion engines have been selected, the vessel can be operated with only one of the two propellers, which means that a desirable redundancy is achieved. Hence even in the event of failure of one propeller, the vessel will be able to reach port without outside assistance.

Depending on the characteristic of the propulsion engines, the propellers can be realized in the form of fixed pitch or variable pitch propellers. This advantage means that even passenger vessels can be designed as single-screw vessels.

On account of the pivoting aft propeller, the vessel has excellent maneuvering characteristics at slow speeds. In particular, excellent maneuvering is possible in narrow waterways, even in the presence of high winds and strong currents.

Rapid landing and casting off presents no particular problems when there is a bow thruster or controllable bow propeller. It is also possible to land or cast off without assistance from tows.

When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the embodiment illustrated in the accompanying drawings.

DESCRIPTION OF THE PREFERRED EMBODIMENT

In the figures, functionally corresponding parts are identified by the same numbers.

Figure 1:
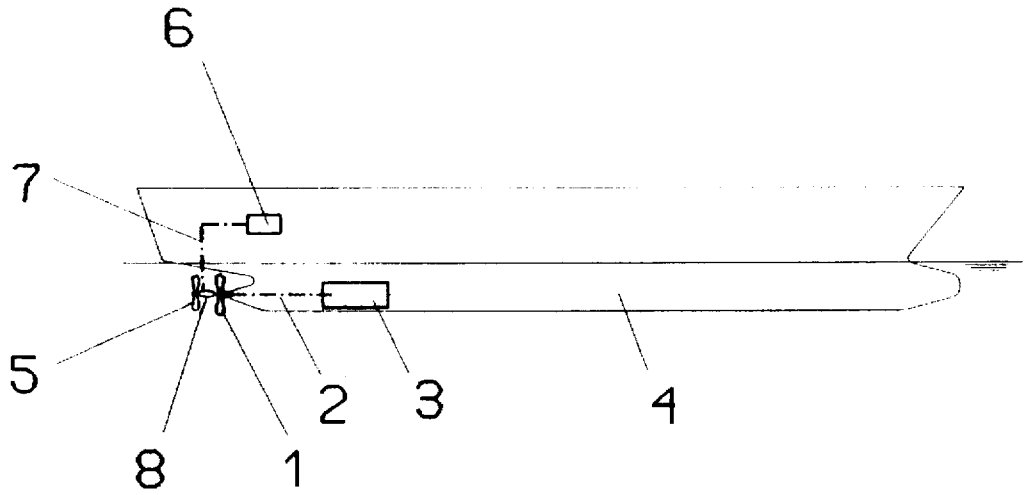
FIG. 1 schematically shows a vessel equipped with the propeller system in a side view.

In accordance with one embodiment, FIG. 1 shows a vessel with hull 4. The vessel has a forward propeller 1 which is driven by means of the drive shaft 2 and the drive system 3. The aft propeller 5 is driven by means of an additional drive system 6, and is realized so that it can pivot around the vertical axis 7. Shown is a realization of the present invention including a rudder plate 8 on which the rear propeller 5 is located.

Figure 2:
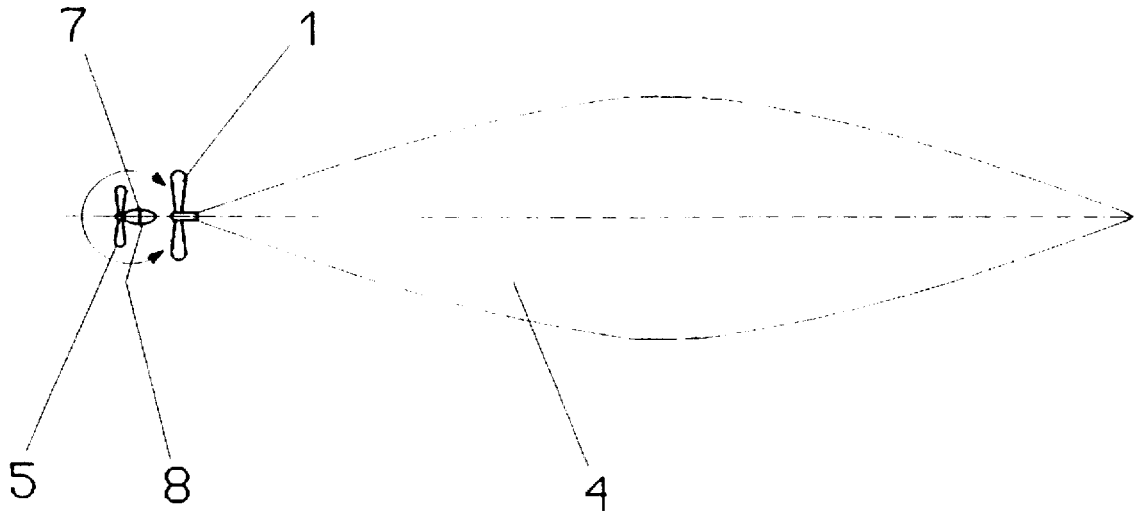
FIG. 2 schematically shows a cross section through the vessel at the level of the propeller.

FIG. 2 is a schematic view of an embodiment cross section through the vessel at the level of the propeller.

Figure 3:
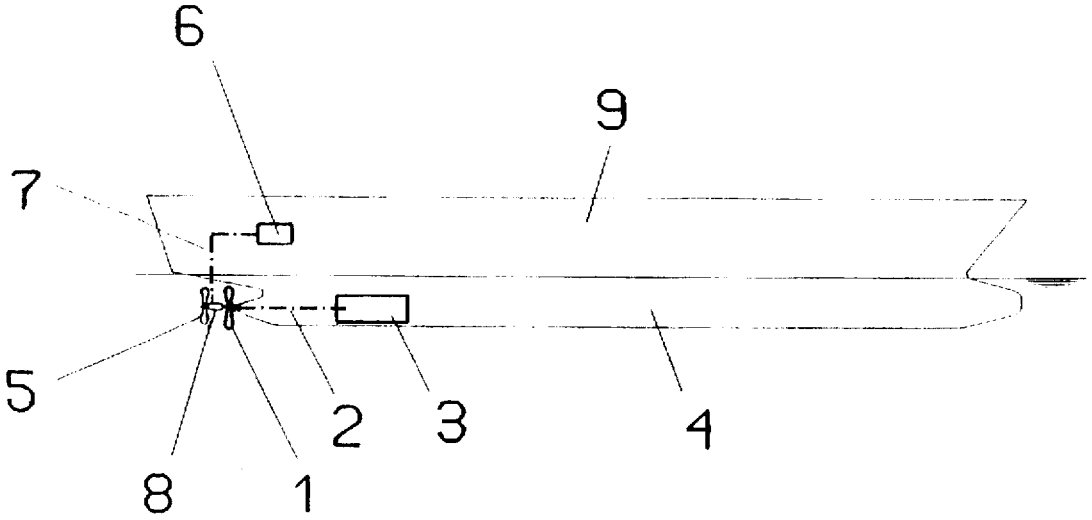
FIG. 3 is similar to FIG. 1, but includes an additional reference number.

FIG. 3 is a schematic view of the embodiment shown in FIGS. 1 and 2 in a vessel 9.

Figure 4:
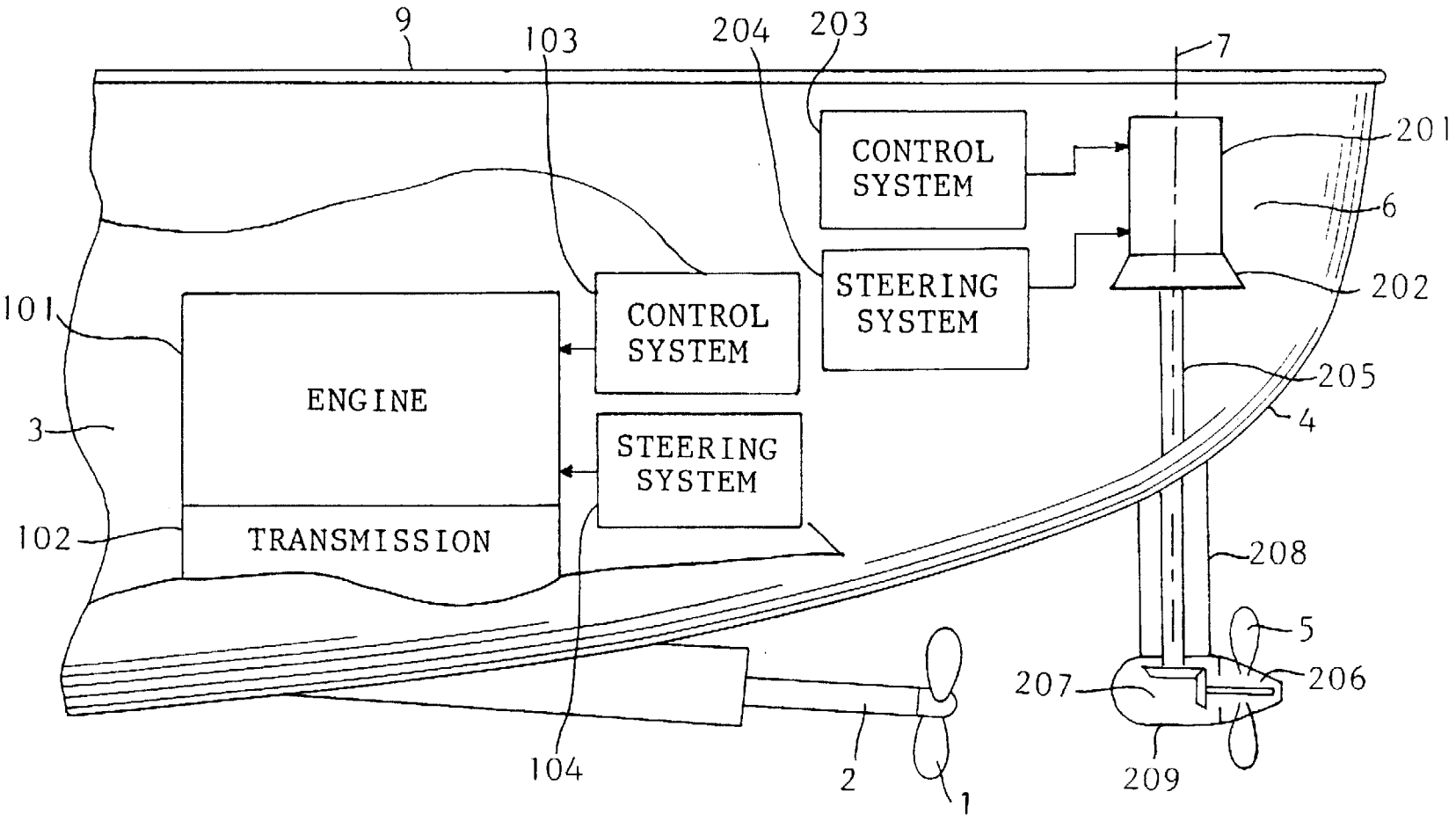
FIG. 4 schematically shows a vessel equipped with another embodiment of the propeller system in a side view.

In accordance with one embodiment, FIG. 4 schematically shows a vessel 9 equipped with the propeller system in a side view. It should be generally understood that the components of a watercraft as briefly discussed below are known, and therefore not discussed in any significant detail herein. The vessel 9 includes a hull 4, which could be a displacement-type hull as found in large vessels. The hull 4 of a displacement-type hull is designed to displace water for bouyant support and to be propelled through the water. Such a hull 4 is shaped to be driven through the water with relatively high efficiency while providing a seaworthy platform for the vessel 9 to carry out its intended tasks.

In an embodiment shown in FIG. 4, the hull 4 is fitted with a conventional drive system 3. The drive system 3 drives the propeller 1 by way of a drive shaft 2. It should also be understood that the conventional drive system 3 can also include a steering system 104, a control system 103, and a transmission system 102 to control the direction and amount of thrust applied to the hull 4 by propeller 1.

In addition to the conventional drive system 3, the embodiment shown in FIG. 4 includes a second drive system 6 that can be used to propel or manuever the vessel 9. The second drive system 6 can be adopted from "thruster" type propeller units used to propel and manuever watercraft, particularly offshore platforms. The second drive system 6 can be a drive system completely separate from drive system 3. The second drive system 6 can include its own engine 201, power transmission apparatus 202, and propeller 5. In particular, the power transmission apparatus 202 can include bevel gearing 207 to transfer drive power to the propeller 5 by means of a drive shaft 205 and horizontal propeller shaft 206. The drive shaft 205 is preferably vertical about vertical axis 7. The drive shaft 205 extends through a tubular support strut 208, the upper end of tubular support strut 208 arranged to be rotatably mounted in an opening in a bottom part of the hull 4. The tubular support strut 208 allows pivotal rotation of the propeller 5 when used with engine 201. The pivoting of propeller 5 can be used to direct the direction of thrust generated by propeller 5 for maneuvering or propulsion of vessel 9.

It should also be understood that the second drive system 6 could also include an independent steering system 204 and an independent control system 203, including appropriate sensors and computers, to direct the direction and amount of thrust applied to the hull 4 by propeller 5.

The propeller 5 can be mounted in a stream-lined housing 209 mounted astern of the propeller 1. The housing 209 can house a portion of the power transmission apparatus 204, including the bevel gearing 207, to allow pivoting of the propeller 5 while being driven by engine 201 mounted within the hull 4.

It should be understood other embodiments of the invention can exist. For example, jet drives could be used in place of propellers to generate thrust. Conventional dual-screw vessels could be adapted to this invention with the inclusion of an additional, separately driven maneuvering/propulsion propeller. And contra-rotating propellers could be employed.

One feature of the invention resides broadly in a propeller drive for watercraft, preferably for ferry boats and car ferries, which has two propellers located one behind the other in the center-line plane, characterized by the fact that the forward propeller 1 is located on a marine shaft 2 which exits the hull 4, and can be driven by means of a drive system 3, that the aft propeller 5 is driven by means of a separate drive system 6, and that the rear propeller 5 is realized so that it can pivot by at least about 90 degrees around an axis 7 which is preferably vertical.

Another feature of the invention resides broadly in the propeller drive characterized by the fact that the aft propeller 5 is located on a type of rudder plate 8.

Yet another feature of the invention resides broadly in the propeller drive characterized by the fact that at least one of the propellers 1, 5 is realized in the form of a variable pitch propeller.

A further feature of the invention resides broadly in the propeller drive characterized by the fact that the propellers 1, 5 may be used singly or in combination to provide propulsive force.

Still another feature of the invention resides broadly in the propeller drive characterized by the fact that with suitable propulsion engines, the propellers 1, 5 provide redundant propulsive means.

And yet another feature of the invention resides broadly in the propeller drive characterized by the fact that the propellers 1, 5 provide high maneuverability at low speed.

Examples of steerable propellers which may possibly be used in accordance with an embodiment of the present invention may be found in the following U.S. Pat. No. 4,573,929 to Savikurki and Jansson on Mar. 4, 1986, entitled "Propeller Device for a Ship"; U.S. Pat. No. 4,586,907 to Florander on May 6, 1986, entitled "Means for Mounting a Thruster Propeller Unit"; U.S. Pat. No. 4,634,389 to Eptaminitakis on Jan. 6, 1987, entitled "Vessel Having Demountable Submerged Propeller Unit"; U.S. Pat. No. 4,694,645 to Flyborg and Bjorheden on Sep. 22, 1987, entitled "Propeller Assembly"; and U.S. Pat. No. 4,696,650 to Haglund on Sep. 29, 1987, entitled "Arrangement for Fitting a Propeller Assembly to an Opening in a Bottom Structure of a Watercraft and for Dismantling the Assembly Therefrom".

Examples of ship propellers which may possibly be used in accordance with an embodiment of the present invention may be found in the following U.S. Pat. No. 5,374,208 to von Bergen et al. on Dec. 20, 1994, entitled "Ship, in Particular Deep Draft Vessel Having Concentric, Contra-Rotating Propellers"; U.S. Pat. No. 5,356,320 to Von Bergen et al. on Oct. 18, 1994, entitled "Seal Arrangement for Propeller Shafts of Ships"; U.S. Pat. No. 5,137,116 to Von Bergen et al. on Aug. 11, 1992, entitled "Sealing Device for a Rotating Shaft of a Ship Propeller Shaft"; U.S. Pat. No. 5,209,497 to Von Bergen et al. on May 11, 1993, entitled "Sealing Apparatus for Rotating Shafts, in Particular Stern Tube Seal for the Propeller Shafts of a Ship"; U.S. Pat. No. 4,419,085 to Laucks et al. on Dec. 6, 1983, entitled "Amphibious Vehicle"; and U.S. Pat. No. 4,465,431 to Gross on Aug. 14, 1984, entitled "Overload Protection Apparatus for Variable Pitch Propellers".

Examples of large ships with which the present invention may be utilized may be found in the following U.S. Pat. No. 4,898,112 to McGlew and McGlew, Jr. on Feb. 6, 1990, entitled "Cargo Ship Having Stowage Space for Floatable Self-Propelled Warehouses"; U.S. Pat. No. 5,140,925 to Tyring on Aug. 25, 1992, entitled "Arrangement in General Cargo Ships Having Side Port Openings"; U.S. Pat. No. 5,299,520 to Wilts on Apr. 5, 1994, entitled "Ship, in Particular Merchant Ship"; U.S. Pat. No. 4,586,908 to Schlichthorst on May 6, 1986, entitled "Exhaust Gas System for the Internal Combustion Engine of a Ship"; U.S. Pat. No. 4,643,643 to Otto on Feb. 17, 1987, entitled "Apparatus for Adjusting & Locking Pitch of a Variable Pitch Propeller on a Ship"; U.S. Pat. No. 4,711,193 to Latza and Mock on Dec. 8, 1987, entitled "Self-Contained Ventilation System Units for Supplying Spaces Between Bulkheads with Individually Circulated Ventilation Air"; and U.S. Pat. No. 4,843,989 to Langenberg on Jul. 4, 1989, entitled "Ship's Hull for Small Vessels and High Speeds".

Examples of ships and other watercraft and vessels which may possibly be used in accordance with one embodiment of the present invention may be found in the following U.S. Pat. No. 5,141,456 to Langenberg et al. on Aug. 25, 1992, entitled "Water Craft with Guide Fins"; U.S. Pat. No. 4,843,989 to Langenberg on Jul. 4, 1989, entitled "Ship's Hull for Small Speed Vessels and High Speeds"; and U.S. Pat. No. 5,388,542 to Fischer et al. on Feb. 14, 1995, entitled "Water-Borne Ship and Method of Operation Thereof".

Examples of further propellers which may be used in accordance with one embodiment of the present invention may be found in the following U.S. Pat. No. 4,900,280 to Midttun on Feb. 13, 1990, entitled "Apparatus for Detecting the Pitch of a Marine Controllable Pitch Propeller"; U.S. Pat. No. 5,171,170 to Ridder, et al. on Dec. 15, 1992, entitled "Ship's Drive with Trolling Device"; and U.S. Pat. No. 5,284,420 to Guimbal on Feb. 8, 1994, entitled "Plastics Multi-Blade Variable-Pitch Rotor".

Some examples of sensors which may be utilized in accordance with the present invention may be or are disclosed in the following U.S. Pat. No. 5,365,768 entitled "Sensor" to Hitachi; U.S. Pat. No. 5,197,326 entitled "Arrangement for Monitoring Rotational Speed Sensor" to Bosch; U.S. Pat. No. 5,239,263 entitled "Magnetic Rotation Sensor for Rotary Shaft"; U.S. Pat. No. 5,309,094 entitled "Bearing Rotary Speed Sensor with Concentric Multipole Magnetic Rings Axially aligned with Collector Branches"; and U.S. Pat. No. 5,192,877 entitled "Hall Effect Sensor and Component Providing Differential Detection".

Some examples of computer or electronic systems which may be utilized in accordance with the present invention may be found in the following U.S. documents: U.S. Pat. No. 5,363,027 entitled "Apparatus and Method of Controlling the Robotic Driving of a Vehicle" to Horiba; U.S. Pat. No. 5,325,082 entitled "Comprehensive Vehicle Information Storage System" to Rodriguez; U.S. Pat. No. 5,253,272 entitled "Digital Data Transmission System with Adaptive Predistortion of Transmitted Pulses" to AMP Incorporated; and U.S. Pat. No. 5,299,200 entitled "Adaptive Interface that Automatically Adjusts for Timing Skews Caused by Signal Delays" to Sharp.

Examples of acceleration sensor arrangements, which may be utilized in accordance with the embodiments of the present invention, may be found in the following U.S. Pat. No. 4,898,033, which issued to Yamamoto on Dec. 6, 1990; U.S. Pat. No. 4,903,982, which issued to Harara et al. on Feb. 27, 1990; U.S. Pat. No. 4,927,170, which issued to Wada on May 22, 1990; U.S. Pat. No. 4,930,082, which issued to Harara et al. on May 29, 1990; and U.S. Pat. No. 4,948,164, which issued to Hano et al. on Aug. 14, 1990.

Examples of lookup table arrangements and related arrangements, which may be utilized in accordance with the embodiments of the present invention, may be found in the following U.S. Pat. No. 4,893,234, which issued to Davidson et al. on Jan. 9, 1990; U.S. Pat. No. 4,920,496, which issued to Szczebak, Jr., on Apr. 24, 1990; U.S. Pat. No. 4,968,985, which issued to Riggle et al. on Nov. 6, 1990; U.S. Pat. No. 4,974,078, which issued to Tsai on Nov. 27, 1990.

Other discussions on propellers in general may be found in Chapter 16, pages 337 to 357, of the book *Modern Ships, Elements of Their Design, Construction and Operation, Second Edition* by La Dage, published by Cornell Maritime Press, Inc. in. 1953 and 1965, with Library of Congress Catalog Card Number 65-21747.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 195 14 878.9-22, filed on Apr. 22, 1995, having inventors Hans Langenberg and Hansjorg Klante, and DE-OS 195 14 878.9-22 and DE-PS 195 14 878.9-22, as well as their published equivalents, in any of the documents cited herein, are hereby incorporated by reference as if set forth in their entirety herein.

The details in the patents, patent applications and publications may be considered to be incorporable, at Applicants' option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A propeller drive for an ocean-going ferry watercraft, the watercraft having a hull with a longitudinal axis, said propeller drive comprising:

an aft propeller mechanism;

an aft propeller drive mechanism to drive said aft propeller mechanism;

a forward propeller mechanism;

a forward propeller drive mechanism to drive said forward propeller mechanism;

said aft propeller mechanism being configured to be disposed astern of said forward propeller mechanism;

an arrangement to pivot said aft propeller mechanism substantially greater than 90 degrees with respect to the longitudinal axis;

said aft propeller mechanism having a drive position to drive a watercraft forward; and at least a portion of said aft propeller drive mechanism being disposed between said forward propeller mechanism and said aft propeller mechanism upon said aft propeller mechanism being disposed in said drive position.

2. The propeller drive according to claim 1, wherein:

said aft propeller mechanism comprises a propeller; and said propeller is configured to be disposed unshrouded into ambient seawater about the watercraft.

3. The propeller drive according to claim 2, wherein:

said forward propeller drive mechanism and said aft propeller drive mechanism comprise an arrangement to jointly propel the watercraft;

said forward propeller drive mechanism comprises a first engine to drive said forward propeller mechanism; and said aft propeller drive mechanism comprises a second engine to drive said aft propeller mechanism.

4. The propeller drive according to claim 3, wherein:

said aft propeller drive mechanism and said forward propeller drive mechanism are separate and independent with respect to one another; and each of said aft propeller drive mechanism and said forward propeller drive mechanism are configured and disposed to permit propulsion of the watercraft in the open ocean by solely one of said aft propeller drive mechanism and said forward propeller drive mechanism.

5. The propeller drive according to claim 4, wherein:

said propeller comprises an aft propeller of said propeller drive;

said forward propeller mechanism comprises a forward propeller;

each of said aft propeller and said forward propeller are configured to be approximately equal in size with respect to one another; and each of said first and second engines are configured to be approximately equal in power output with respect to one another.

6. The propeller drive according to claim 5, the hull of the watercraft having a waterline, the hull of the watercraft defining a central plane extending along the longitudinal axis of the hull, wherein:

said first engine is configured to be disposed in the hull of the watercraft;

said forward propeller drive mechanism comprises a marine shaft;

said marine shaft extends between said first engine and said forward propeller to transmit torque from said first engine to said forward propeller;

said marine shaft comprises a portion configured and disposed to exit the hull of the watercraft;

said forward propeller is mounted on said portion of said marine shaft;

said aft propeller is configured to be disposed a first distance below the waterline of the watercraft;

said forward propeller is configured to be disposed a second distance below the waterline of the watercraft, the second distance being substantially equal to the first distance;

said arrangement to pivot said aft propeller mechanism is configured to pivot said aft propeller around a substantially vertical axis with respect to the waterline of the watercraft;

said arrangement to pivot said aft propeller mechanism is configured to orient the pivoting axis in substantially the central plane of the hull of the watercraft;

said forward propeller is configured to rotate about a first axis of rotation;

said aft propeller is configured to rotate about a second axis of rotation; and each of the first axis of rotation and the second axis of rotation is oriented in substantially the central plane of the hull of the watercraft.

7. The propeller drive according to claim 6, said propeller drive further comprising:

a rudder blade; and said aft propeller mechanism is mounted on said rudder blade.

8. The propeller drive according to claim 7 wherein said aft propeller is disposed aft of said rudder blade.

9. The propeller drive according to claim 8, wherein at least one of said forward propeller and said aft propeller comprises a variable pitch propeller.

10. The propeller drive according to claim 9, wherein:

said forward propeller drive mechanism comprises a first control system;

said forward propeller drive mechanism comprises a first steering system;

said aft propeller drive mechanism comprises a second control system; and said aft propeller drive mechanism comprises a second steering control system.

11. A propeller drive for an ocean-going watercraft, the watercraft having a hull, the hull of the watercraft having a longitudinal axis, said propeller drive comprising:

an aft propeller mechanism;

a forward propeller mechanism;

said aft propeller mechanism being configured to be disposed astern of said forward propeller mechanism;

an arrangement to pivot said aft propeller mechanism substantially greater than 90 degrees with respect to the longitudinal axis around an axis;

a first drive system for driving said forward propeller mechanism;

a second drive system for driving said aft propeller mechanism;

said first and second drive systems comprising an arrangement to jointly propel the watercraft on the open ocean; and each of said first and second drive systems comprising an arrangement to independently propel the watercraft on the open ocean.

12. The propeller drive according to claim 11, wherein:

said first and second drive systems are separate from one another to selectively permit each of said first and second drive systems to solely propel the watercraft on the open ocean;

said first drive system comprises a first engine to generate power to drive said forward propeller mechanism;

said second drive system comprises a second engine to generate power to drive said aft propeller mechanism;

said first engine is configured to permit propulsion of the watercraft on the open ocean solely by the power generated by said first engine; and said second engine is configured to permit propulsion of the watercraft on the open ocean solely by the power generated by said second engine.

13. The propeller drive according to claim 12, wherein:

said forward propeller mechanism comprises a forward propeller;

said forward propeller is configured to permit propulsion of the watercraft on the open ocean solely by said forward propeller being driven by said first engine;

said aft propeller mechanism comprises an aft propeller; and said aft propeller is configured to permit propulsion of the watercraft on the open ocean solely by said aft propeller being driven by said second engine.

14. The propeller drive according to claim 13, wherein said aft propeller is an unshrouded propeller to permit said aft propeller to be disposed within ambient seawater.

15. The propeller drive according to claim 14, said propeller drive further comprising:

a rudder blade being configured to be attached to the watercraft to form a rudder; and said aft propeller is attached to said rudder blade.

16. The propeller drive according to claim 15, wherein said aft propeller is disposed astern of said rudder blade.

17. The propeller drive according to claim 16, wherein at least one of said forward and aft propellers comprises a variable pitch propeller.

18. The propeller drive according to claim 17, the hull of the watercraft having a waterline, the hull of the watercraft defining a central plane extending along the longitudinal axis of the hull, wherein:

said first engine is configured to be disposed within the hull of the watercraft;

said first drive mechanism comprises a marine shaft;

said marine shaft extends between said first engine and said forward propeller to transmit torque from said first engine to said forward propeller;

said marine shaft comprises a portion configured and disposed to exit the hull of the watercraft;

said forward propeller is mounted on said portion of said marine shaft;

said aft propeller is configured to be disposed a first distance below the waterline of the watercraft;

said forward propeller is configured to be disposed a second distance below the waterline of the watercraft, the second distance being substantially equal to the first distance;

said arrangement to pivot said aft propeller mechanism is configured to pivot said aft propeller around a substantially vertical axis with respect to the waterline of the watercraft;

said arrangement to pivot said aft propeller mechanism is configured to locate the pivoting axis in substantially the central plane of the hull of the watercraft;

said forward propeller is configured to rotate about a first axis of rotation;

said aft propeller is configured to rotate about a second axis of rotation; and each of the first axis of rotation and the second axis of rotation is oriented in substantially the central plane of the hull of the watercraft.

19. The propeller drive according to claim 18, the ocean-going watercraft comprising an ocean-going ferry, wherein:

said first drive system comprises a first control control system;

said first drive system comprises a first steering system;

said second drive system comprises a second control system; and said second drive system comprises a second steering system.

* * * * *

UNITED STATES PATENT AND TRADEMARK OFFICE

CERTIFICATE OF CORRECTION

PATENT NO. : 5,795,199
DATED : August 18, 1998
INVENTOR(S) : Hans LANGENBERG and Hansjörg KLANTE It is certified that error appears in the above-identified patent and that said Letters Patent is hereby corrected as shown below:

In column 3, line 19, after 'or', delete "manuever" and insert --maneuver--.

In column 3, line 21, after 'and', delete "manuever" and insert --maneuver--.

Signed and Sealed this

Twenty-fifth Day of May, 1999

*Attest:*

Q. TODD DICKINSON

*Attesting Officer*

*Acting Commissioner of Patents and Trademarks*